US006866414B2

(12) United States Patent
Kupidlowski

(10) Patent No.: US 6,866,414 B2
(45) Date of Patent: Mar. 15, 2005

(54) SANITARY MIXING ASSEMBLY FOR VESSELS AND TANKS

(75) Inventor: Frank Kupidlowski, Oregon City, OR (US)

(73) Assignee: JV Northwest, Inc., Canby, OR (US)

( * ) Notice: Subject to any disclaimer, the term of this patent is extended or adjusted under 35 U.S.C. 154(b) by 241 days.

(21) Appl. No.: 10/155,831

(22) Filed: May 22, 2002

(65) Prior Publication Data

US 2002/0176322 A1 Nov. 28, 2002

Related U.S. Application Data

(60) Provisional application No. 60/292,993, filed on May 22, 2001.

(51) Int. Cl.[7] ..... B01F 7/22

(52) U.S. Cl. ..... 366/330.3; 366/330.4; 366/330.5; 416/242

(58) Field of Search ..... 366/330.1, 330.2, 366/330.3, 330.4, 330.5, 343; 416/237, 238, 242, 243, DIG. 2, DIG. 3

(56) References Cited

U.S. PATENT DOCUMENTS 904,656 A * 11/1908 Steiger ..... 416/242
1,473,066 A * 11/1923 Wells ..... 416/243
1,508,086 A * 9/1924 Crawford ..... 416/242
1,977,072 A * 10/1934 Lyman ..... 416/242
1,995,193 A * 3/1935 Stilphen ..... 416/242
2,684,723 A * 7/1954 Faber ..... 416/237
3,014,534 A * 12/1961 Vartiainen ..... 416/238
4,147,437 A * 4/1979 Jonqueres ..... 366/343
4,364,712 A * 12/1982 Charles ..... 416/237
4,468,130 A * 8/1984 Weetman ..... 366/330.2
4,519,715 A * 5/1985 Golobic et al. ..... 366/343
4,601,583 A * 7/1986 Amorese ..... 366/343
4,721,394 A * 1/1988 Casto et al. ..... 366/343
4,722,608 A * 2/1988 Salzman et al. ..... 366/330.5
5,161,953 A * 11/1992 Burtis ..... 416/243
5,297,938 A * 3/1994 Von Essen et al. ..... 366/330.3
5,316,443 A * 5/1994 Smith ..... 366/330.1
5,326,168 A * 7/1994 Miura ..... 366/343
5,813,837 A * 9/1998 Yamamoto et al. ..... 366/330.5
5,951,162 A * 9/1999 Weetman et al. ..... 366/330.3
6,116,856 A * 9/2000 Karadgy et al. ..... 416/242
6,299,412 B1 * 10/2001 Wood et al. ..... 416/223 A
6,334,705 B1 * 1/2002 Weetman ..... 366/330.1

* cited by examiner

*Primary Examiner*—Tony G. Soohoo
(74) *Attorney, Agent, or Firm*—Kolisch Hartwell P.C.

(57) ABSTRACT

The present invention provides component parts for a mixing assembly adapted to be used with clean in place techniques. The component parts may include an impeller assembly, an adjustable hub assembly and a steady bearing assembly. In one embodiment, the blades of the impeller assembly may be adapted to direct a portion of the water initially aimed at the top surface of the blade towards the bottom surface of the blade.

20 Claims, 4 Drawing Sheets

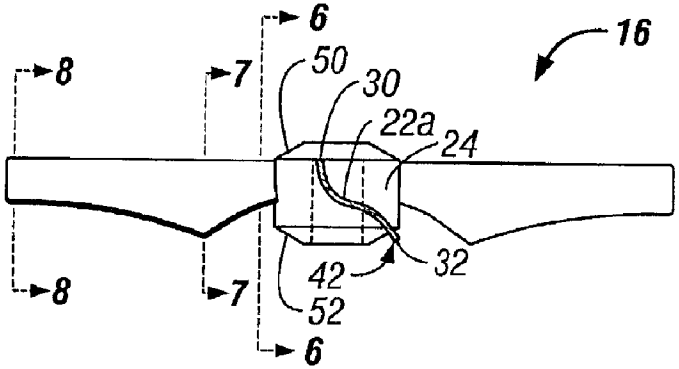
FIG. 5
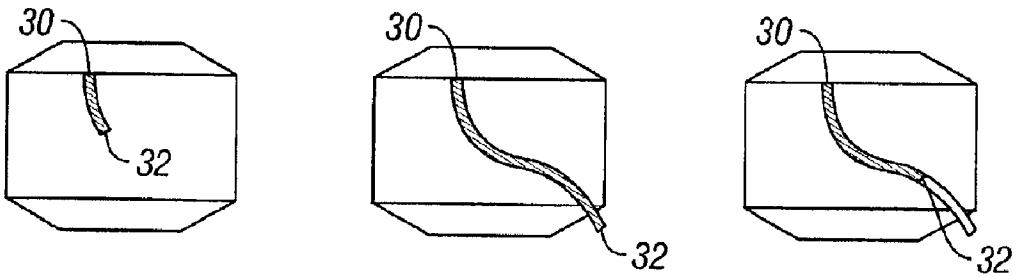
FIG. 6
FIG. 7
FIG. 8

SANITARY MIXING ASSEMBLY FOR VESSELS AND TANKS

CROSS REFERENCE TO RELATED APPLICATIONS

The present application claims priority from U.S. Provisional Patent Application Ser. No. 60/292,993, filed May 22, 2001, which is hereby incorporated by reference in its entirety for all purposes.

BACKGROUND OF THE INVENTION

Sanitary mixing vessels and tanks are used in a wide variety of applications including the food, dairy, beverage, pharmaceutical, and cosmetic industries. Typically, the mixing vessel employs a mixing assembly including a shaft and a rotating impeller blade to mix the contents of the vessel. In many industries, including those mentioned above, it is vitally important that the mixing assembly be thoroughly cleaned between uses. As will be appreciated, it is also important that the mixing assembly, and any component parts, be cleaned in a quick, efficient and cost-effective manner.

SUMMARY OF THE INVENTION

In one embodiment, the present invention provides an impeller assembly for a mixing vessel. The impeller assembly may be rotatably engaged with a shaft and comprise a plurality of blades radiating from a central hub. Each of the blades may have a generally curved leading edge adapted to direct a portion of liquid initially aimed at the top surface of the blade towards the bottom surface of the blade. Each of the blades may further have a trailing edge with an outer portion being generally tapered outwards and an inner portion being generally tapered inwards, thereby forming a central apex corresponding to the widest point of the blade.

In another embodiment, the present invention provides a hub assembly. The hub assembly may include a bushing adapted to receive a shaft and a housing having a first portion adapted to sealingly engage a second portion. The housing typically receives the bushing and may be tapered at opposing ends.

In another embodiment, the present invention provides a bearing assembly for a mixing vessel. The bearing assembly may include a supporting structure having a fitting and a plurality of legs extending from the fitting. The legs are typically secured to the vessel. The bearing assembly may further include a guide bearing having a bore adapted to receive a shaft. The guide bearing is typically adapted to be removably engaged by the supporting structure. Moreover, the guide bearing may be removable from the supporting structure and shaft without necessitating removal or lifting of the shaft.

In yet another embodiment, the present invention provides a mixing assembly for a vessel including a shaft, an impeller assembly, a hub assembly and a bearing assembly.

In a further embodiment, the present invention provides a sanitary impeller having a hub and a blade extending from the hub. The hub may have a bore for fixing the impeller to a shaft along an axis defined by the bore. The blade may have a cross section which, when viewed in a plane generally parallel to the axis of the bore, progresses from a near linear shape to a curvilinear S-shape and then to a curvilinear L-shape as a point of view progresses along the blade from adjacent the hub to a distal end of the blade.

In another embodiment, the present invention provides a mixing assembling including a shaft, a hub operatively engaged to the shaft, and a blade extending from the hub. The blade may have a cross section which, when viewed in a plane generally parallel to the axis of the bore, progresses from a near linear shape to a curvilinear S-shape and then to a curvilinear L-shape as a point of view progresses along the blade from adjacent the hub to a distal end of the blade.

In yet another embodiment, the present invention provides a mixing vessel including a plurality of nubbins operatively connected to the mixing vessel. The nubbins may define a bearing receptacle spaced away from a surface of the vessel. The mixing vessel also may include a shaft extending into the bearing receptacle and a guide bearing having a bore and mounted on the shaft. The guide bearing may be removably engaged by the nubbins and include a channel into which at least one of the nubbins extends. Moreover, the guide bearing may be slid out of the bearing receptacle without necessitating removal or lifting of the shaft.

The advantages of the present invention will be understood more readily after a consideration of the drawings and the Detailed Description.

BRIEF DESCRIPTION OF THE DRAWINGS

FIG. 5 is a side view of the impeller assembly shown in FIG. 1.

FIG. 6 is a cross-section of a blade of the impeller assembly of FIG. 5 taken along the line 6—6.

FIG. 7 is a cross-section of a blade of the impeller assembly of FIG. 5 taken along the line 7—7.

FIG. 8 is a cross-section of a blade of the impeller assembly of FIG. 5 taken along the line 8—8.

DETAILED DESCRIPTION AND BEST MODE OF THE INVENTION

The present invention provides a mixing assembly including component parts that can be easily cleaned in a sanitary mixing vessel or tank.

Figure 1:
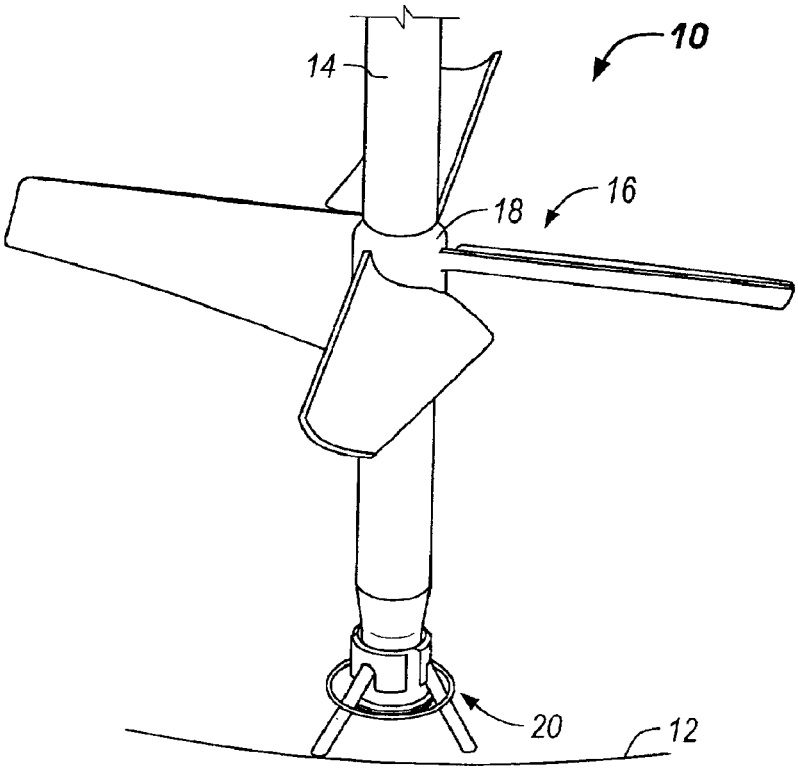
FIG. 1 is an isometric view of one embodiment of a mixing assembly according to the present invention.
Figure 2:
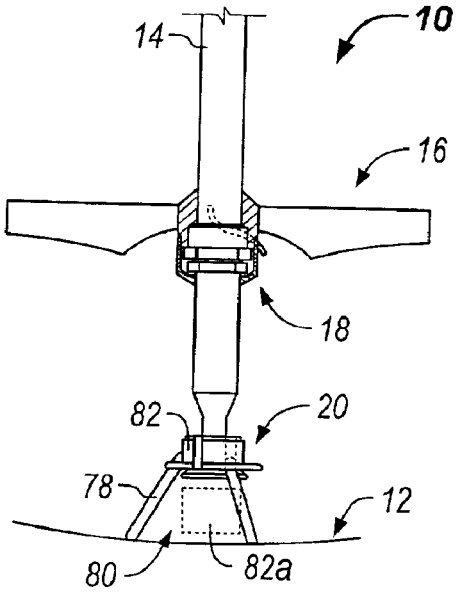
FIG. 2 is a side view of another embodiment of a mixing assembly according to the present invention.

Mixing assemblies according to the present invention are shown in FIGS. 1 and 2. Mixing assembly 10 is generally adapted for use in a vessel 12 and includes a shaft 14, an impeller assembly 16, an adjustable hub assembly 18, and a steady bearing assembly 20. As shown, impeller assembly 16 is rotatably engaged with shaft 14 via adjustable hub assembly 18. Generally, one end of shaft 14 is secured to a motor drive (not shown) to rotate the shaft within vessel 12. If necessary or desired, the non-secured end of shaft 14 may be steadied via bearing assembly 20. Each of the components may be made of stainless steel or any other suitable material.

As will be appreciated, impeller assembly 16, adjustable hub assembly 18, and steady bearing assembly 20 are each component parts of mixing assembly 10 and may, therefore, be used separately or in combination with each other or other component parts. For example, a steady bearing is not required for all applications, in which case mixing assembly 10 may include impeller assembly 16 and adjustable hub assembly 18 but not steady bearing assembly 20. As another example, as will be discussed in further detail below, the impeller assembly 16 may be used in combination with any suitable hub including a welded hub as shown in FIGS. 3–8 or an adjustable hub such as that shown in FIGS. 2 and 9.

Each component of mixing assembly 10 is adapted to be adequately washed or cleaned using a method known as "clean in place" (CIP). Typically, CIP methods involve spraying cleaning and sanitizing fluids into the vessel and onto the surfaces of vessel's internal components without removing or disassembling any of the internal components. Moreover, according to the present invention, each component of mixing assembly 10 is adapted to be easily and thoroughly cleaned when a cleaning or sanitizing fluid is sprayed towards mixing assembly 10 from a single direction. Typically, the CIP process is performed while the mixing assembly is being rotated.

Figure 3:
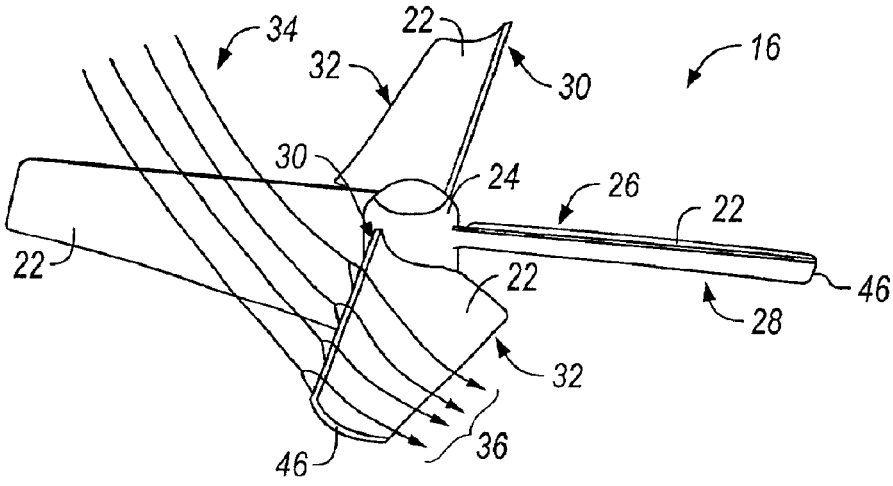
FIG. 3 is a perspective view of an impeller assembly according to the present invention.

FIG. 3 is a perspective view of one embodiment of impeller assembly 16. Impeller assembly 16 is shown with impeller blades 22 extending from a central hub 24. Impeller assembly 16 may include four blades, as shown. However, as will be appreciated, impeller assemblies having more than four or fewer than four blades may be desirable and are contemplated by the present invention.

As shown, each blade 22 has an top surface 26, a bottom surface 28, a leading edge 30, and a trailing edge 32. The "top surface" as used in the present discussion, shall be defined as that surface towards which fluid spray 34 is initially directed. According to the present invention, the leading edge 30 of each blade may be curved such that the curvature of the leading edge directs at least a portion of the liquid initially aimed at top surface 26 towards bottom surface 28, as shown by arrows 36. Thus, fluid may be delivered to both the top and bottom surfaces of the blade without requiring that the fluid be expelled from multiple sources in the mixing vessel. For example, fluid need not be sprayed from sources located both above and below impeller assembly 16 in order to thoroughly rinse both sides of blades 22.

Figure 4:
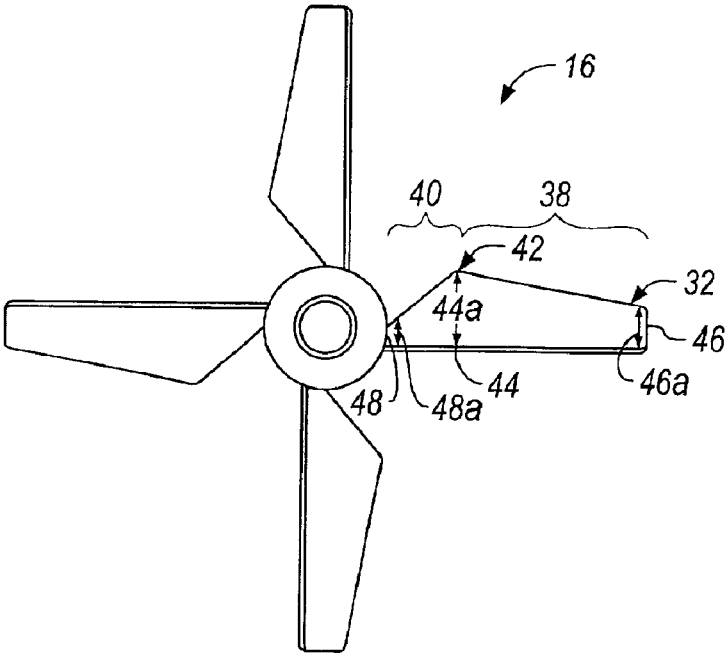
FIG. 4 is a plan view of the impeller assembly shown in FIG. 1.

FIG. 4 is a plan view of the impeller assembly of FIG. 3. As shown, trailing edge 32 may be bidirectionally tapered with an outer region 38 being generally tapered outwards and an inner region 40 being generally tapered inwards, forming an apex 42. Thus, blade 22 may have a central region 44 having a width 44*a* greater than width 46*a* of distal edge 46. As shown, width 46*a* of distal edge 46 is greater than width 48*a* of attachment edge 48. However, it is contemplated that widths 46*a* and 48*a* may vary in relationship to each other. Likewise, in the embodiment shown, inner region 40 is approximately one-third the total length of blade 22. However, it is contemplated that the ratio of inner region 40 to outer region 38 may be greater or lesser than that depicted in FIG. 4.

FIG. 5 is a side view of the impeller assembly of FIG. 3. FIG. 6 is a cross-section of FIG. 5 taken along the line 6—6. By comparing FIGS. 4, 5, and 6, it can be seen that inner region 40 may be sufficiently tapered such that most, if not all, of attachment edge 48 adjacent hub 24 is at a near vertical pitch.

Returning to FIG. 5, it can be seen with reference to blade 22*a*, that at the widest point, i.e. in the region of the blade corresponding to central portion 44, the curvature of blade 22*a* may be roughly s-shaped, beginning at leading edge 30 with a near vertical pitch, curving to a near horizontal pitch in the middle and ending with a near vertical pitch at apex 42 on trailing edge 32. This S-shape is also seen in FIG. 7, which is a cross-section of blade 22*a* in FIG. 5, taken along line 7—7, the widest point of the blade.

Moreover, as shown in cross-section in FIG. 8, due to the tapering of trailing edge 32, as described above, distal edge 46 may have a generally L-shaped conformation, beginning with a near vertical pitch at leading edge 30 and ending with a near horizontal pitch at trailing edge 32. As shown in FIG. 3, the trailing edge at this point may have a slight downward pitch.

Returning to FIG. 4, hub 24 may be a welded hub to which blades 22 are permanently attached. Welded hub 24 may include tapered opposing surfaces 50 and 52. As will be appreciated, alternative hubs may be used in conjunction with impeller assembly 16, including the adjustable hub shown in FIG. 1 and described in greater detail below.

Figure 9:
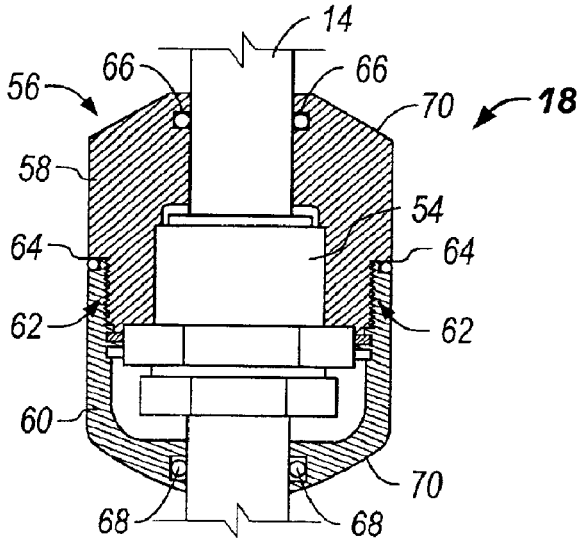
FIG. 9 is a side view of the hub assembly shown in FIG. 2.

FIG. 9 is a side sectional view of an adjustable hub assembly 18 according to the present invention. Adjustable hub assembly 18 rotatably engages impeller assembly 16 to shaft 14 via a bushing 54, which may act as a two-way compression fitting. The bushing may be of any suitable type including those generally referred to as keyless bushings and described in U.S. Pat. Nos. 4,202,644, 4,600,334, and 5,696,296, each of which is incorporated by reference in its entirety for all purposes. The adjustable hub assembly 18 further includes a housing 56 adapted to receive the bushing. The housing includes a first region 58 and a second region 60. Typically, the first and second regions are configured to sealingly engage each other, such as through a screw type connection 62. If desired, a static seal, such as o-ring 64 may be placed at the intersection of the first region 58 and second region 60 to ensure water tightness. Additional static seals, such as o-rings 66 and 68 may be employed to ensure a watertight seal between housing 56 and shaft 14. As will be appreciated, the static seal may take any suitable form including a molded square gasket or the like.

As will be appreciated, adjustable hub assembly 18 may be used with any style of impeller. Typically, the impeller blades are mounted to first region 58. In one particularly desirable combination, impeller blades of the style discussed above with respect to FIGS. 3–8 are mounted to first region 58. As with hub 24, the outer ends of housing 56 may be tapered, as shown at 70.

Figure 10:
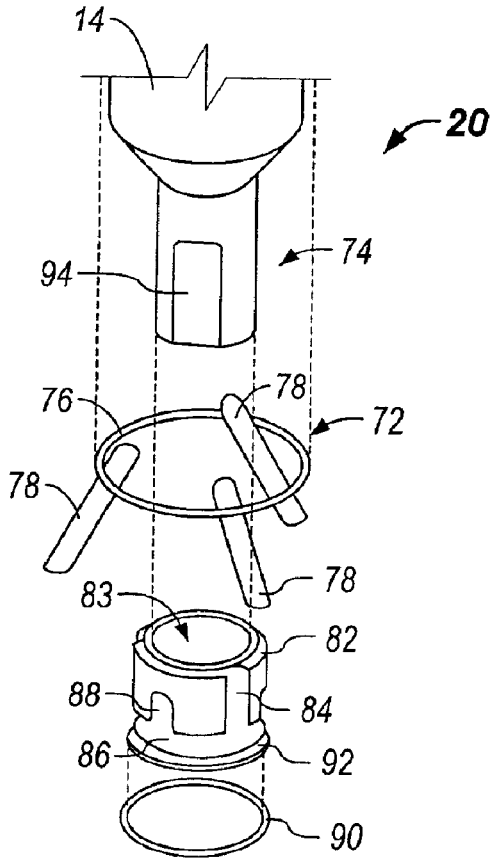
FIG. 10 is an exploded view of the steady bearing assembly shown in FIGS. 1 and 2.

FIG. 10 is an exploded view of a bearing assembly 20 according to the present invention. Bearing assembly 20 includes a supporting structure 72. Support structure 72 may include a fitting 76 having a plurality of legs, or nubbins, 78 extending from the fitting. Supporting structure 72 may be adapted to removably receive bearing 82. Bearing 82 includes a bore 83, which is adapted to receive a bearing contact area 74 at the end of shaft 14.

Turning briefly to FIG. 2, nubbins 78 are typically secured to mixing vessel 12. Nubbins 78 generally extend outward so as to provide a space 80 through which bearing 82 may be removed or inserted, as shown by bearing 82*a*. This structure allows for the installation and removal of bearing 82 without necessitating removal or lifting of shaft 14.

Returning to FIG. 10, to install bearing 82, slots 84 in bearing 82 are aligned with nubbins 78 on supporting structure 72. Bearing 82 is inserted from underneath shaft 14 and rotated along channel 86 until nubbins 78 set into grooves 88, minimizing the contact area between nubbins 78 and bearing 82. This minimization of the contact area eliminates shadowing of cleaning solution and maximizes the area of the entire assembly that is exposed to the cleaning solution (and thus cleaned.)

If desired, a static seal such as o-ring 90 may be installed around lower lip 92 of bearing 82. As will be appreciated, the static seal may take any suitable form including as a molded square gasket or the like.

Shaft 14 may include one or more milled flats 94 in bearing contact area 74. The milled flats 94 may allow cleaning solutions onto the bearing surfaces for ease of cleaning.

The subject matter of the inventions includes all novel and non-obvious combinations and subcombinations of the various elements, features, functions and/or properties disclosed herein. Similarly, where the disclosure recites "a" or "a first" element or the equivalent thereof, such disclosure should be understood to include incorporation of one or more such elements, neither requiring nor excluding two or more such elements.

What is claimed is:

1. An impeller assembly for a mixing vessel, the impeller assembly being rotatably engaged with a shaft, the impeller assembly comprising a plurality of blades radiating from a central hub, each of said blades having:

a top surface and a bottom surface;

a generally curved leading edge adapted to direct a liquid initially aimed at the top surface towards the bottom surface; and a trailing edge having an outer portion generally tapered outwards and an inner portion generally tapered inwards, thereby forming a central apex corresponding to a widest point of the blade, wherein the widest point of the blade has a curvature that is roughly s-shaped and the distal edge of the blade has a curvature that is generally L-shaped.

2. The impeller assembly of claim 1 wherein the hub is a welded hub.

3. The impeller assembly of claim 1 wherein the hub is an adjustable hub assembly comprising a bushing adapted to receive the shaft.

4. The impeller assembly of claim 3 wherein the adjustable hub assembly further comprises a housing including a first portion and a second portion, the first portion being adapted to sealingly engage the second portion.

5. The impeller assembly of claim 4 wherein the first and second portions each have external surfaces and internal surfaces, the external surfaces being generally tapered at opposing ends and the internal surfaces being adapted to receive the bushing.

6. An impeller assembly for a mixing vessel, the impeller assembly being rotatably engaged with a shaft, the impeller assembly comprising a plurality of blades radiating from a central hub, each of said blades having:

a top surface and a bottom surface;

a generally curved leading edge adapted to direct a liquid initially aimed at the top surface towards the bottom surface; and a trailing edge having an outer portion generally tapered outwards and an inner portion generally tapered inwards, thereby forming a central apex corresponding to a widest point of the blade, wherein the widest point of the blade has a curvature that is roughly s-shaped and the portion of the blade attached to the central hub has a near vertical pitch.

7. The impeller assembly of claim 6 wherein the hub is a welded hub.

8. The impeller assembly of claim 6 wherein the hub is an adjustable hub assembly comprising a bushing adapted to receive the shaft.

9. The impeller assembly of claim 8 wherein the adjustable hub assembly further comprises a housing including a first portion and a second portion, the first portion being adapted to sealingly engage the second portion.

10. The impeller assembly of claim 9 wherein the first and second portions each have external surfaces and internal surfaces, the external surfaces being generally tapered at opposing ends and the internal surfaces being adapted to receive the bushing.

11. A sanitary impeller comprising:

a hub having a bore for fixing the impeller to a shaft along an axis defined by the bore;

a blade extending from the hub, wherein a cross section of the blade viewed in a plane generally parallel the axis of the bore progresses from a near linear shape to a curvilinear S-shape, and then to a curvilinear L-shape as a point of view progresses along the blade from an attachment edge adjacent the hub to a distal end of the blade.

12. The sanitary impeller of claim 11 wherein a cross section of the blade has a maximum area at an apex of the blade.

13. The sanitary impeller of claim 12 wherein the apex is located approximately one-third of the distance between the attachment edge and the distal end.

14. A mixing assembly comprising:

a shaft;

a hub operatively engaged to the shaft; and a blade extending from the hub, wherein a cross section of the blade viewed in a plane generally parallel the axis of the bore progresses from a near linear shape to a curvilinear S-shape and then to a curvilinear L-shape as a point of view progresses along the blade from adjacent the hub to a distal end of the blade.

15. An impeller assembly for a mixing vessel, the impeller assembly being rotatably engaged with a shaft, the impeller assembly comprising a plurality of blades radiating from a central hub, each of said blades having:

a top surface and a bottom surface;

a generally linear leading edge; and a bidirectionally tapered trailing edge having an outer portion generally tapered outwards and an inner portion generally tapered inwards, thereby forming a central apex corresponding to a widest point of the blade, wherein a distal edge has a generally L-shaped curvature.

16. The impeller assembly of claim 15 wherein the widest point of the blade has a curvature that is roughly S-shaped.

17. The impeller assembly of claim 16 wherein a portion of the widest point of the blade has a near horizontal pitch.

18. The impeller assembly of claim 15 wherein an attachment edge of the blade has a near vertical pitch.

19. The impeller assembly of claim 18 wherein the apex is located approximately one-third of the distance between the attachment edge and the distal edge.

20. The impeller assembly of claim 15 wherein a cross section of the blade viewed in a plane generally parallel to the shaft progresses from a near linear shape to a curvilinear S-shape, and then to a curvilinear L-shape as a point of view progresses along the blade from adjacent the shaft to the distal edge of the blade.

* * * * *